United States Patent [19]

Grayden

[11] Patent Number: 4,737,073

[45] **Date of Patent: * Apr. 12, 1988**

[54] PUMP

[75] Inventor: Paul A. Grayden, Wantirna South, Australia

[73] Assignee: Prescant Pty. Limited, Australia

[ * ] Notice: The portion of the term of this patent subsequent to Jan. 20, 2004 has been disclaimed.

[21] Appl. No.: 912,058

[22] Filed: Sep. 26, 1986

Related U.S. Application Data

[62] Division of Ser. No. 733,861, May 14, 1985, Pat. No. 4,637,780.

[30] Foreign Application Priority Data

May 14, 1984 [AU] Australia ..... PG4969

[51] Int. Cl.[4] ..... F04D 29/04

[52] U.S. Cl. ..... 415/213 R; 415/170 R

[58] Field of Search ..... 415/213 R, 170 R, DIG. 3

[56] References Cited

U.S. PATENT DOCUMENTS

| | | | |
|---|---|---|---|
| 271,139 | 1/1883 | Sharpneck | 415/213 |
| 730,052 | 6/1903 | Sharpneck | 415/213 |
| 791,244 | 5/1905 | Carpenter et al. | 415/213 |
| 2,422,901 | 6/1947 | Hunter | 415/213 |
| 3,711,218 | 1/1973 | Kennel et al. | 415/213 |
| 4,637,780 | 1/1987 | Grayden | 415/171 |

*Primary Examiner*—Robert E. Garrett
*Assistant Examiner*—John T. Kwon
*Attorney, Agent, or Firm*—Larson and Taylor

[57] ABSTRACT

A water ring vacuum pump including a body with end members, an impeller within the body and having extending outwardly from each end a shaft journaled for rotation in a bearing in the adjacent end member. Each shaft is extended by a stub shaft of equal diameter which abuts the impeller shaft in a driving connection within the bearing.

3 Claims, 4 Drawing Sheets

PUMP

This is a division of application Ser. No. 733,861 filed May 14, 1985, now patented U.S. Pat. No. 4,637,780.

This invention relates to an improved and, more specifically, to an improved water ring vacuum pump.

One area where water ring vacuum pumps are widely used is in the dairy industry where they can supply the vacuum for the inflators of milking machines. Another area where they can have wide applications is in pumps which can operate as wet vacuum cleaners, where a mixture of liquid and air is to be drawn into and through the pump. There are also other industrial applications where a large quantity of air is to be pumped from a system, where water ring vacuum pumps are of great value.

In water ring vacuum pumps generally, there is a body in which there is mounted an impeller, the axis of which is offset from the central axis of the body and, in operation, there is sufficient water maintained in the body at all times to provide a seal between the internal periphery of the body and the impeller. The depth of water forming this seal is usually dependent upon the location of an exhaust port and can easily be established and maintained.

In order to operate the pump efficiently, it is also necessary to provide a good seal between the ends of the impeller and adjacent the ends of the pump body. In the type of pumps to which the invention relates these ends are normally formed by port plates which are normal to the axis of the impeller and which terminate closely adjacent the impeller.

It is in this aspect that there have been problems in conventional water ring vacuum pumps as it has been complicated to set up a pump so that the spacing between the ends of the impeller and the adjacent port plates is correct and, where there is any wear, which can occur with abrasive material working across the port plate, it has been very difficult, if not impossible to reset the pumps on site.

It is an object of the present invention to provide a means whereby the adjustment between the port plates and the associated ends of the impeller can be readily and easily done and, in particular, can be done on site without special tools.

Another area in which previous water ring pumps have been less than fully satisfactory is in the effective movement of the air through the pump and out of the exhaust port.

It will be appreciated that efficiency of operation demands ready movement of air through the pump.

It is an object of the invention to overcome, or at least minimise, this difficulty.

A further area in which conventional water ring pumps have been less than satisfactory is that, at each end, there has often been a build up of abrasive material adjacent the impeller shaft and this material can, in time, damage the shaft, the seal and/or the port plate surface adjacent the end of the impeller.

A further object of the invention is to overcome or minimise this difficulty.

A still further difficulty which has been met in previous water ring vacuum pumps is in the arrangement of the impeller and its shaft.

Generally, the impeller has been mounted on a full length shaft which needs to be carefully machined and have accurate key ways cut therein.

It is a further object of the invention to provide an improved arrangement of impeller and impeller shaft assembly.

It is a still further object to provide a water ring vacuum pump which is basically simple in manufacture and construction but which can provide good long term operation with minimal service and, when service is necessary, for this largely to be able to be carried out in the field and to be economical in both time and components.

In a first aspect, the invention includes a water ring vacuum pump having:

(a) a body;
(b) end members on the body;
(c) an impeller in the body and having a shaft extending through the end members;
(d) the impeller shaft extending through the end members being journalled for rotation therein;
(e) an inlet in one end member;
(f) an outlet in the other end member;
(g) a port plate located in each end member and being located adjacent the blades of the impeller whereby a manifold is formed between each port plate and its adjacent end chamber;
(h) the pump being characterised in that each port plate is moveable relative to its adjacent end member by screws or the like passing through the end member, which screws abut the face of the port plate and can act to cause its location against the impeller and locking means passing through the end member and into threads in the port plate whereby the port plate can be moved away from the impeller, the said locking means, when the impeller is correctly positioned, acting against the screws or the like which abut the port plate, thus serving to lock the port plate in position.

By the use of such an arrangement, the location of the port plate relative to the impeller can readily be adjusted in the field to account for wear and to thereby restore the optimum operating condition of the pump, without the necessity of the pump being dissembled.

In a second aspect, the invention includes a water ring vacuum pump having:

(a) a body;
(b) end members on the body;
(c) an impeller in the body and having a shaft extending through the end members;
(d) the impeller shaft extending through the end members being journalled for rotation therein;
(e) an inlet in one end member;
(f) an outlet in the other end member;
(g) a port plate located in each end member and being located adjacent the blades of the impeller whereby a manifold is formed between each port plate and its adjacent end chamber;
(h) the pump being characterised in that at the inlet end there is a chamber in the port plate about the shaft of the impeller, but not in contact with the manifold and wherein the impeller has at least one passage therethrough whereby pressure air at the inlet end of the pump is caused to move to the chamber and through the impeller to the exhaust end of the pump where it can be passed to exhaust.

Preferably I may provide, at each end of the impeller, an annulus to which the shaft of the impeller is fixed and about which there are a plurality of apertures spaced above the centre of the impeller, which is hollow, whereby water fills the central portion of the impeller, to the level of the apertures in the annuli, whereby this water, when the pump is operating acts as a dynamic balancer for the impeller, the exhaust air passing through the central portion of the impeller axially within the water.

In a still further aspect I provide a water ring pump including:

(a) a body;
(b) end members on the body;
(c) an impeller in the body and having a shaft extending through the end members;
(d) the impeller shaft extending through the end members being journalled for rotation therein;
(e) an inlet in one end member;
(f) an outlet in the other end member;
(g) a pump being characterised in that the impeller has a shaft member extending outwardly from each end thereof, each of which shaft members is located in the inner race of a bearing, a stub shaft associated with each impeller shaft member within the inner race and being in driving connection therewith.

The outwardly directed portions of the impeller can be formed to be closely received within the inner race of a bearing and which have, on their ends, means whereby each can be interconnected, in driving relationship, with a stub shaft which can also be received in the inner race of the bearing, means interconnecting the stub shafts to the impeller components.

In order that the invention may be more readily understood, I shall describe, in relation to the accompanying drawings, one particular form of pump made in accordance with the invention, which pump illustrates the various aspects of the invention.

Figure 1:
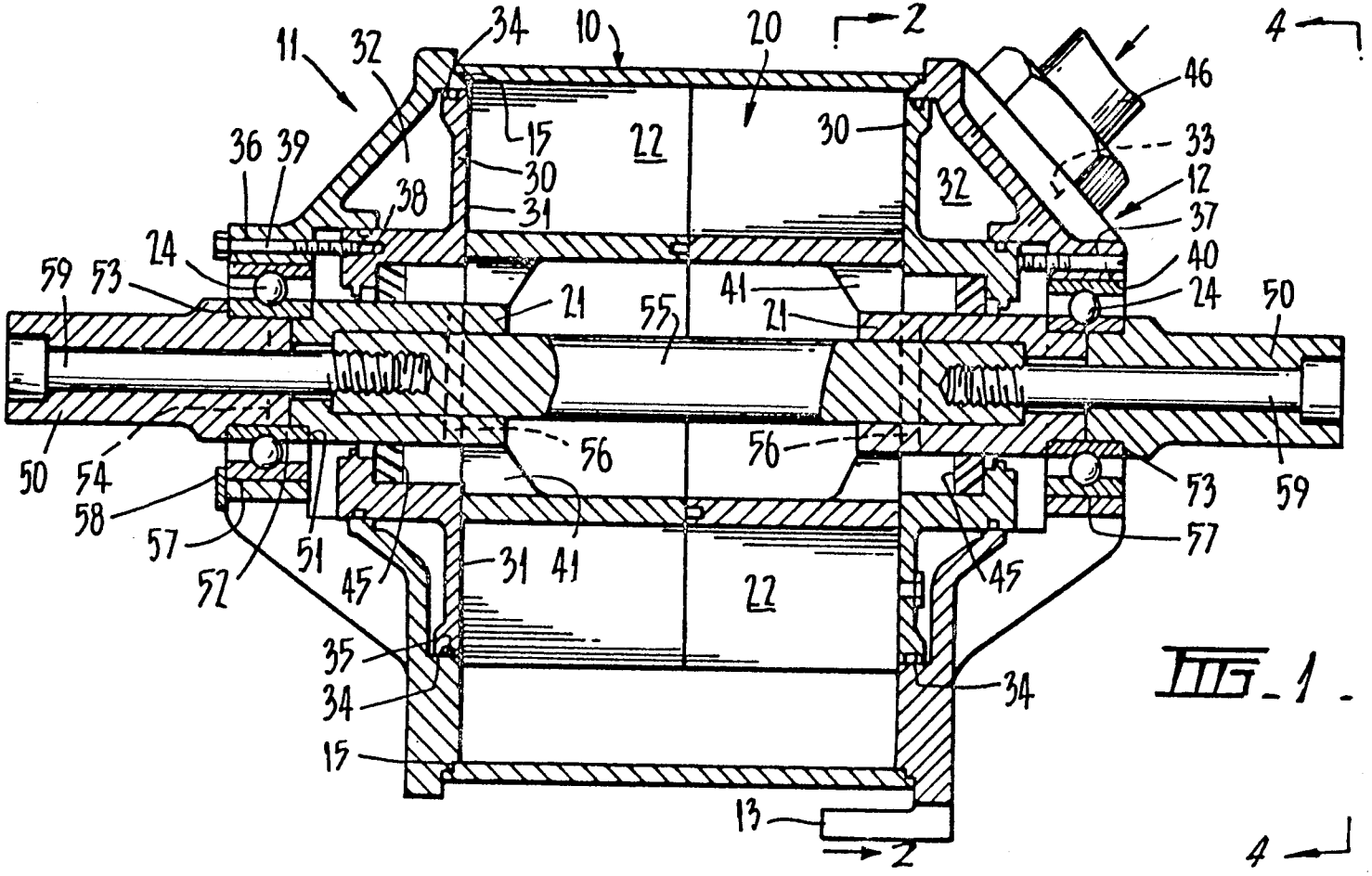
FIG. 1 is a longitudinal, sectional view of the water ring vacuum pump of the invention.

Basically the pump comprises a body 10 which can, effectively, be a cylindrical tube and end members 11, 12 which are adapted to be located in sealing relationship with each end of the body. The seals are not shown.

Preferably, these end members may be cast, and satisfactorily can be formed of cast iron, and may be provided with legs 13, by means of which the pump can be located and a plurality of apertured lugs or the like which are adapted to receive rods which pass through the apertures 14 in the lugs and which are then tightened between the lugs by nuts or the like.

Preferably, the body may have an internal shoulder 15 which co-acts with an inwardly directed cylindrical extension from the body members and a seal may be made by means of an O-ring or the like, which is not shown, located between the body 10 and each end member 11, 12.

These seals act not only to provide the necessary seal between the components but, because they are in compression when the components are assembled by the rods, they act to separate the components when the tension is released as they attempt to assume their initial condition. Thus, I have found that, because of this, even after long periods of operation under test, pumps of the present invention can readily be dissembled without the necessity of use of great force thereon.

Mounted in the body is an impeller 20, a preferred form of which will be described hereinafter, which impeller has effectively a central shaft 21 about which it can rotate and a plurality of blades 22 extending outwardly from the shaft, at an angle to the radial plane at which their root is located.

Each end member 11, 12 has an aperture therethrough, spaced from its axis, and which is adapted to co-operate with a bearing on or associated with the shaft of the impeller, the impeller thus being rotatable about an axis offset from the axis of the body. This can be well seen in FIG. 1.

Located in each end member there is a port plate 30, and I prefer to use port plates of bronze, and these are adapted, as will be discussed further hereinafter, to present a surface 31 closely adjacent the corresponding end of the impeller 20.

The outer surface of the port plate also serves to act as one wall of a manifold 32, the remainder of which is formed by the end member 11 or 12. Passing into each end member, outwardly of the port plate and thus into the manifold, there is an aperture 33 whereby connection to either a source of air or exhaust, depending upon which end is considered. Each aperture 33 can be connected to a pipe 46 or the like.

In the port plate, effectively in alignment with the aperture 33, there is a port.

Figure 2:
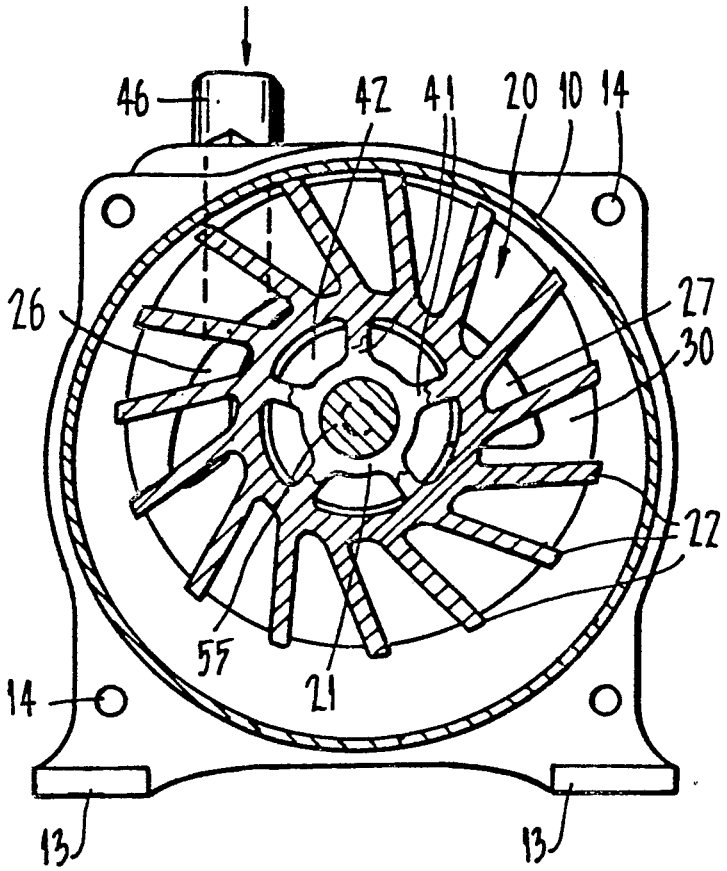
FIG. 2 is a sectional view along the line 2—2 of FIG. 1 looking in the direction of the arrows.
Figure 3:
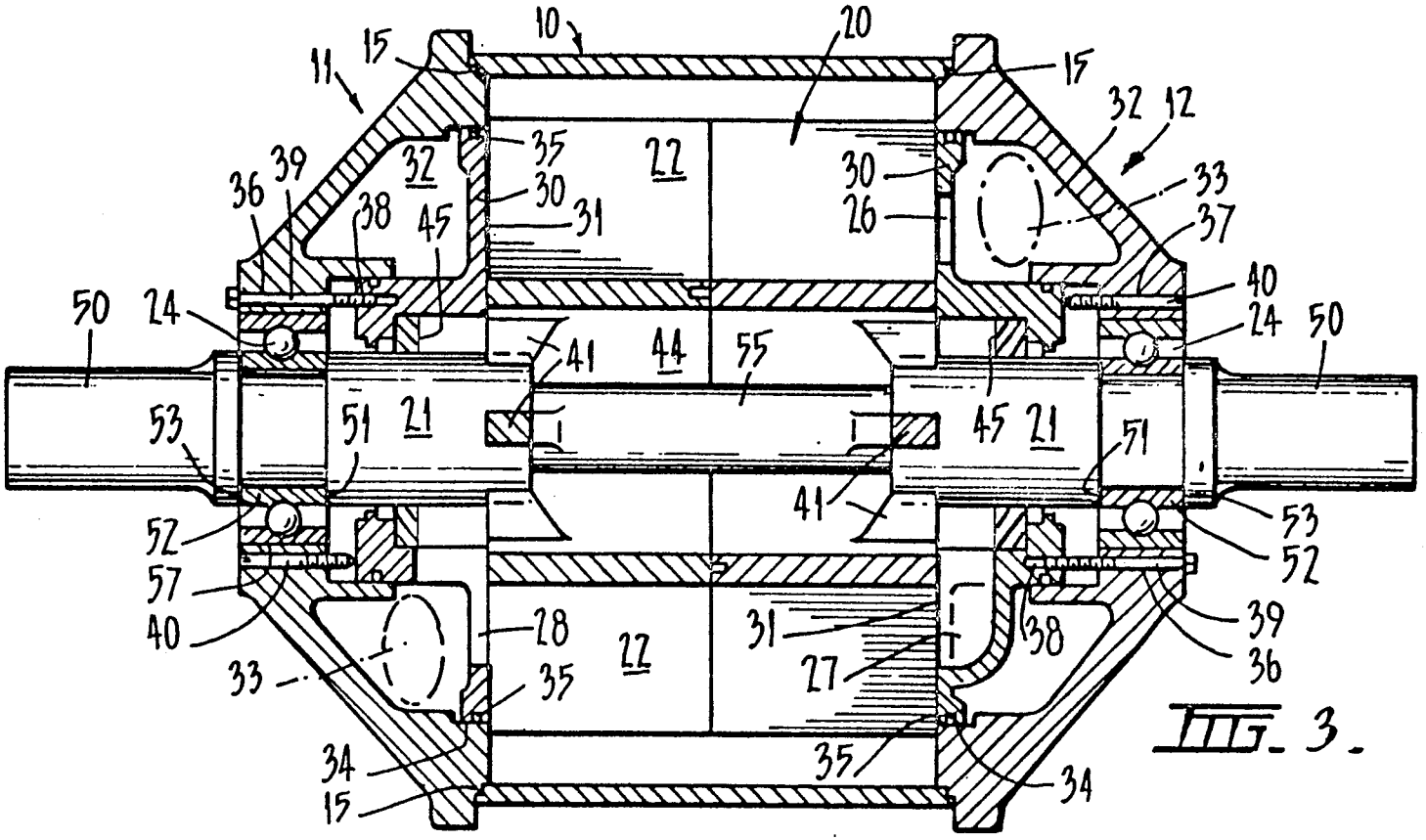
FIG. 3 is a view, partially in section, taken along line 3—3 of FIG. 1 looking in the direction of the arrows.
Figure 4:
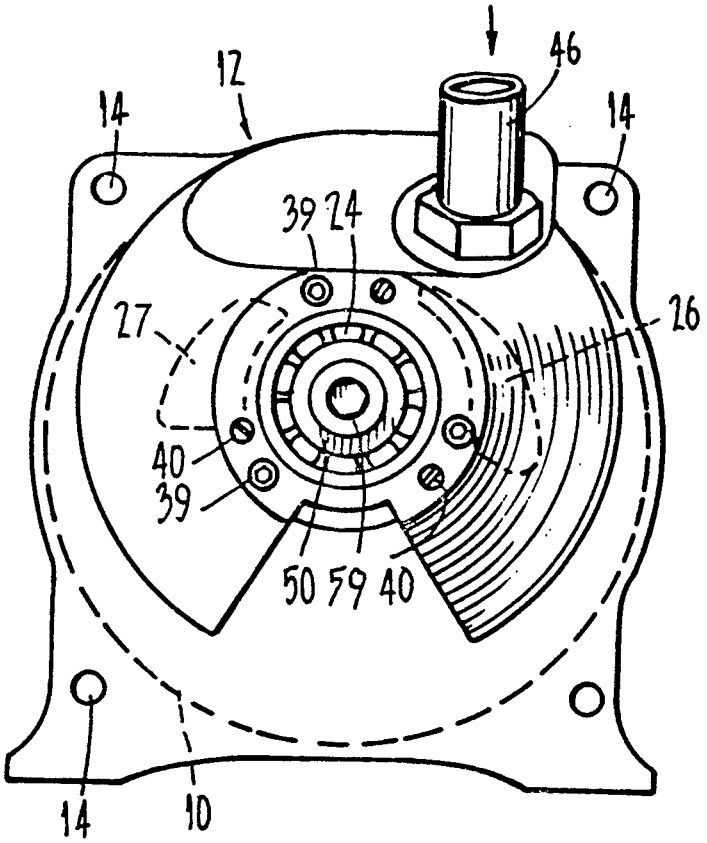
FIG. 4 is an end view of the pump of FIG. 1 looking along line 4—4.

FIG. 2 shows the inlet port 26 and also shows a second port member 27 in the end plate at the inlet end which port 27 is, effectively, in alignment with the exhaust port 28 which is in the other end plate and which is illustrated in FIG. 3.

It may be noted that the two end members can be identical, thus minimising the cost of patterns. When they are connected to opposite ends of the body, the inlet and outlet are located on opposite sides of the central plane through the body.

It is in the relative location of the port plate 30 with the associated end member 11, 12, and thus, inherently, with the end of the impeller 20, that one feature of the invention relates.

Preferably, the interior of the end member is machined to provide a cylindrical surface 34 which is preferably of a depth slightly greater than the width of the port plate 30, which is also cylindrical in form, and the two surfaces may preferably be machined so that they are a close push or press fit. For greatest possible efficiency of operation, we provide a seal 35, preferably an O-ring seal, between the port plate and the end member.

Whilst in this specification I refer specifically to certain seals, it will be seen that other seals, which are not described or illustrated in the drawings, may be used. The operation of these seals is conventional and will not be separately described.

Passing through portions of the end members 11, 12, radially outwardly of the bearing 24, there are six apertures 36, 37, in two sets of three, the apertures of each set being spaced at 120° angles, one to the other, and, preferably, the two corresponding apertures of each set are located closely adjacent each other.

One of the sets 37 of the apertures is threaded and the other set 36 is not.

In the port plate there are three threaded apertures 38 which are adapted to receive bolts 39 passing through the three unthreaded apertures 36 in the end member.

Passing through the threaded apertures in the end member, there can be threaded members 40 which can abut the rear of the port plate 30.

Using such an arrangement, it will be seen that, if the pump is assembled with the port plate adjacent the inner part of the cylindrical recess 34 in the end member, then there will be an unknown spacing between the adjacent end of the impeller and the inner face 31 of the port plate 30.

However, if the members 40 passing through the threaded apertures 37 in the body are tightened, and assuming that the bolts 39 passing into the threaded apertures 38 in the port plate are loose, then tightening of the members 40 will cause the port plate 30 to move inwardly into the body until it is brought into contact with the end of the impeller.

By manipulating the three threaded members, so the port plate can be brought into direct contact with the end of the impeller, even if, say, this does not lie accurately in a plane normal to the axis of the body.

When this position is achieved, the threaded members 40 can each then be withdrawn by a predetermined amount and, if the bolts 39 threaded into the port plate are then tightened, this will draw the port plate back hard onto the threaded members 40 and will effect locking of the port plate 30, with the inner face 31 of the port plate then being spaced from the end of the impeller by a calculated amount, which is effectively the distance the port plate has been moved outwardly prior to being locked, and with the plane of the port plate being parallel to the plane of the face of the end of the impeller 20.

Thus, it will be seen that it is then simple to ensure that there is a close, constant, spacing between the end of the impeller and the inner face of the port plate. Also, it will be seen that this adjustment is achieved after the pump is assembled and without the necessity of using any complex jigs or other aids.

It will be further appreciated that if, after a period of wear in service, it appears that the spacing between the port plate and the impeller has become too great, it is only necessary to repeat this operation, without even disassembling the pump, to reset the port plate relative to the impeller blade. This, as will be seen, is a great advantage as it can be readily done in the field and it may be possible to effect such an adjustment on a number of occasions before it is even necessary to disassemble the pump. If, in time, wear is uneven, it may be necessary to reface or replace the port plate and reface the end of the impeller, but it will be appreciated that adjustment is easy to achieve.

This aspect, in itself, is of a great benefit relative to previously known vacuum pumps.

The pump of the present invention also differs from previous pumps in its manner of handling the air which is to pass to exhaust.

In most previous pumps, and as generally described hereinbefore, the port plate at one end of the pump provides an inlet port 26 and that at the other end, an outlet port 28. The design of these ports can vary greatly depending upon the particular characteristics required from the pump, but it will be appreciated that they are normally located in the upper part of the port plate so that, at rest, a certain volume of water remains in the pump body. When the impeller starts to rotate, this water is picked up by the various impeller blades, moves upwardly and outwardly as the speed of the impeller blade increases, and forms the water ring which effects a seal between the tips of the impeller blades and the inner surface of the body.

The impeller, as previously mentioned, is offset relative to the axis of the body and, thus, the volume defined by each adjacent pair of impeller blades and the water ring as the blades pass around the periphery of the body varies and the arrangement of the inlet and exhaust ports are such that, when the space between two adjacent impeller blades passes over the inlet port 26, the volume is increasing and, thus, material is drawn in from inlet port 26 and, as the blades pass towards the exhaust port 28, then the volume is decreasing, the air caught between the blades is compressed and, as the port opens, so the air is passed out through the port.

It will be seen that, depending upon the particular arrangement and positioning of the ports, so either a maximum air flow can be achieved with a minimum power usage or, if required, maximum vacuum can be achieved.

One problem which has been noticeable in previous vacuum pumps is that it can be difficult, if the impeller is of any length, that is, if the pump is to move a substantial volume of air, to rapidly and completely vent the air contained between two adjacent impeller blades during the period in which the exhaust port 28 is open to the space between the blades.

A feature of the pump of the invention is that I have improved this aspect substantially.

In order to do this, I have made the central body of the impeller substantially hollow 44 with an inwardly directed annulus 41 at each end whereby the impeller shaft can be located. This arrangement will be described further later, but it is obtained by forming the impeller of two impeller halves so that the particular construction can be achieved.

In the annulus at each end, I provide a plurality of slots 42 which must be located to provide an optimum result, as will be described hereinafter, but for the present it is only necessary to appreciate that these enable ingress to and egress from the centre 44 of the impeller which, thus, effectively, together with the hollow central body of the impeller provides a passageway from the inlet end to the exhaust end of the pump.

In the inlet port plate 30 I provide a second port 27 which is, in effect, a duplicate of the exhaust port except that this is enlarged to encompass the area surrounding the portion of the inlet port plate through which the impeller shaft passes.

The operative portion of this port 27 can, to all purposes, be considered to be similar to the port at the other end of the pump and the arrangement is such that, when the exhaust port 28 at the exhaust end of the pump can be considered to open, as far as the spacing between two impeller blades is concerned, so also can the exhaust port 27 at the inlet end of the pump. As the exhaust port at the inlet end enables connection between the spacing between the impeller blades and the centre of the impeller shaft so there is movement of compressed air over the end of the impeller into the hollow shaft, through the length of the impeller shaft and to the exhaust port 28 at the exhaust end.

This arrangement, as will be appreciated, permits movement of air more rapidly than is possible if it can only move from the end adjacent the exhaust port, thus more complete scavanging of the air is possible giving more efficient operation of the pump.

The arrangement, at the exhaust end, preferably includes formation of a recessed annulus about the impeller shaft which opens into the exhaust port 28 in the plate which, in turn, opens to the manifold 32 formed between the port plate 30 and the pump end 11, and passes through exhaust through the outlet.

This hollow construction of the impeller gives a further advantage in that, and as previously mentioned, the apertures 42 through the annulus at each end of the impeller are so located as to spaced inwardly from the outer portion of the hollow impeller so that, as water enters the hollow portion, it does not immediately pass through the impeller but is thrown outwardly against the wall of the hollow central portion of the impeller and builds up until its depth is equal to the spacing between the inner portion of the impeller and the outer portions of the apertures, at which time it is passed out of the impeller at the exhaust end.

This arrangement then, when the impeller is spinning, provides a quantity of dynamic balancing fluid within the impeller so that, should there be any variation in the impeller casting so that the impeller is not completely balanced, this will be compensated for by the mass of water in the impeller and the impeller will run truly and smoothly.

This, of course, lessens any radial loads on the bearings 24 of the impeller and increases the overall operating life of the pump before service is necessary.

The arrangement of the additional exhaust also provides a further advantage which has not previously been obtainable.

In previous vacuum pumps, there has usually been a form of recess about the shaft of the pump where it passes through each of the port plates, as there may well be a seal, similar to seal 45, or the like mounted therein, which seal can be lubricated by the water in the pump. It will be seen that, if solid material enters into this recess, it effectively stays in the recess as there is no simple way for it to move.

Over a period of time, this can cause great damage to the shaft, to the seal if provided, and can also, when the deposit builds up, cause abrasive damage to the port plate and/or the end of the impeller as the solid material is forced out of the aperture and across the port plate.

Using the exhaust arrangement of the invention, this material, as will be appreciated, tends to be drawn through the centre of the impeller and delivered to exhaust with the water so there should never be an excessive build up of abrasive material at either end of the pump.

It will be seen that, with the exhaust at the inlet end including an annulus around the impeller shaft, there is only a relatively small spacing between the inlet port and the exhaust port but, because of the capability of good adjustment of the port plate relative to the end of the impeller blade, and because of the fact that the area is kept substantially free from any abrasion, a good seal is made in this area.

It will also be seen that with this water in this annulus there is good effective lubrication of the seal 45 and, thus, the seal life should be extended.

The arrangement of impeller used in the pump of the present invention also differs from impellers previously used in water ring vacuum pumps.

It has been conventional to us either impellers cast in one piece or split impellers which are cast in two pieces and, in each case, it was necessary to form an impeller shaft which passes through the full length of the pump, and which had to be of stainless steel or other strongly anti-corrosive material and which had to machined accurately and provided with key ways whereby the impeller or impeller components could be connected thereto.

Particularly where split impellers are used, this could involve complex machining of a shaft of substantial length, which was not satisfactory.

In order to minimise this problem, I have arranged to use a pair of stub shafts 50 rather than a full shaft. the outwardly directed ends 21 of the impeller, together with the stub shafts, are adapted to be received within the inner races of the bearings 24.

The arrangement is such that the inner end of each impeller component has a shoulder 51 adapted to abut the side of the inner race 52 of the bearing 24 and the stub shaft 50 also has a shoulder 53 which is adapted to abut this race from the other side. The total length of the portions of the impeller and the shaft are such that they effectively meet part way along the length of the bearing and the shaft is preferably provided with a pair of dogs 54 on its outer end which enter keys in the outer end of the impeller.

It will be seen that, where the impeller is made of bronze (a softer material than the steel from which the stub shaft is made,) by forming the components in this way, there is a substantial amount of material on the impeller to resist deformation and, of course, as the impeller is a relatively close fit within the race, so any deformation which includes radial outward deformation is restricted.

The form of impeller illustrated, which will be described more fully hereinafter, is but one way of forming an impeller which satisfactorily meets the requirements of the invention.

An alternative form of impeller will be described after the description of the form illustrated.

The impeller illustrated is made of two components which have located therein a idler or retaining shaft 55 or the like which may be of stainless steel and which is internally threaded at each end.

The assembly comprising the two impeller components and the idler are pre-assembled and retained as an assembly by any required method.

In an alternative form, the impeller may be a one piece impeller having a central bore therethrough and, in one specific form, this bore may be provided with ribs running axially therealong which are tapped to receive studs or the like.

An end plate is fitted to each end of the impeller, and the end plate may be in the form of a spider and the central portion may be provided with an outwardly directed portion which can be considered to be the same as the central shaft 21 of the illustrated impeller.

This end component assembly may be made by casting stainless steel or the like.

The annular portion can be provided with apertures therethrough which are effectively identical to the equivalent apertures on the form of impeller illustrated so as to provide access to the interior of the impeller to permit the flow of air and water therethrough.

Whilst I have discussed hereinbefore an impeller made of either one or two components, it would be quite possible, in some applications where large volume displacements were required, to replace a two component impeller with a three or more component impeller.

When the pump is being assembled, I prefer to locate the bearings in recesses 57 in the outer face of the end members, so that they are ready of access and, preferably, the bearings fit into a relatively closely machined apertures and are held by members 58 passing over the outer race on both sides. Preferably the bearing at one end is held by members abutting the outer race, at either side thereof and approximately the same position about the periphery of the race. This locates the bearing against longitudinal axial movement, and serves to locate the impeller relative to the body. At the same time, it can permit a certain movement of the impeller axis relative to the axis of the body.

This arrangement permits a very small amount of movement of the whole bearing in its aperture to take into account small variations in machining tolerances at the same time longitudinal movement is prevented thus permitting accurate adjustment of the port plates.

Because the arrangement of the impeller is exceptionally rigid, and provided initial machining is correct, there should be no side loads whatever on the bearing due to machining inaccuracies and, if required, it is possible to use high quality double row bearings which do not permit any degree of relative movement between the inner and outer races as such a movement should not be present. These bearings can have an extremely long life if they have no undesirable loading.

The arrangement of the bearings in their locating apertures does give a very small degree of movement which can take into account what would be the expected range of manufacturing tolerances.

When the end plate is fitted, with the end of the impeller entering into the bearing inner race, then each stub shaft is placed into the bearing from the outer side, the dogs are brought into alignment and, in the illustrated embodiment, a stud 59 or the like is passed through from the outer end of the stub shaft into the threaded end of the idler in the impeller and the assembly is tightened so that both the impeller and the stub shaft closely embrace the outer surfaces of the inner race of the bearing and, at this stage, the assembly is rigidly interconnected.

In the alternative form of impeller described, the end casting may be provided with a tapped aperture in the centre of the central portion of the spider or elsewhere in the shaft and, into this, a stud similar to stud 59 may be connected.

It will be seen that an arrangement such as those described readily permit variations in the form of stub shaft used with any particular pump depending upon the particular drive means to be used and/or output means required.

Thus, instead of assembling pumps only on particular order, or carrying a number of different types of pumps already assembled, it will be seen that it is very simple simply to remove the threaded stud 59 and the stub shaft 50 from the bearing and replace the stub shaft with the required stub shaft and simply reconnect the stud 59.

This gives a degree of flexibility which has not heretofore been available.

Another aspect of the pump of the invention is that it can readily be used to provide a high vacuum in a manner which is simpler than has previously been possible.

Normally, where pumps of this type are to be used to provide a high vacuum, there is normally provided a second pump having its inlet at the outlet of the first pump so that a two stage arrangement is provided.

The pump of the present invention can provide such a two stage arrangement in a single pump body.

In order to do this, it is only necessary to make what are relatively minor variations to the pump described herein.

Firstly, the impeller is effectively closed part way along its length, and for convenience I shall say midway along its length.

If the impeller is a split impeller, a solid plate can be connected between the two components or, alternatively, the impeller can be made with fillets or the like between each pair of impeller blades at the required position.

Thus, looking at this pump from the inlet side, when the pump is operating, whilst the air cannot move from one end of the impeller to the other, the air can take the alternative path, that is back in the direction of the inlet air to the hollow centre of the shaft and towards the normal exhaust direction.

However, instead of permitting this air to pass to exhaust, I use this as the inlet air for the second stage of the pump and so I divert this air so that it enters into the space between the blades of the impeller where these have maximum volume.

This air then goes through the compression process previously described and can be exhausted from the normal exhaust port of the second end.

Thus it will be seen that the pump, when so modified, acts as a two stage pump and thus can pull higher vacuums than would normally be the case with a single water ring pump.

It will also be appreciated that the cost of supplying such a pump will only be slightly more than the cost of the single phase pump described.

It will be seen from the foregoing that the pump of the invention has numerous advantages beyond more conventional water ring vacuum pumps, particularly in the case of assembly and ease of service and, also, in efficiency of operation by permitting and a dual exhaust arrangement.

It will also be appreciated that not all of these features may necessarily be required on any particular pump and pumps which have combinations of these are equally within the invention as a pump having all of these features.

I claim:

1. A water ring vacuum pump including:

(a) a body;

(b) end members on the body;

(c) an impeller within the body;

(d) a shaft extending outwardly from each end of the impeller and journaled for rotation in a bearing in the adjacent end member; and (e) a stub shaft of a diameter equal to the diameter of the impeller shaft abutting the impeller shaft in alignment therewith within the bearing and in driving connection with the impeller shaft.

2. A pump as claimed in claim 1 wherein the impeller is assembled from two components and wherein a shaft member is integrally formed with each impeller component.

3. A pump as claimed in claim 2 wherein there is an idler shaft coaxial with the impeller shafts and located therewithin, the idler shaft being fixed relative to the impeller shafts, the idler shaft having a tapped coaxial aperture in each end, the stub shafts being in connection with the idler shaft by a stud passing axially through each stub shaft and into the tapped aperture thereof.

* * * * *